US005288585A

United States Patent [19]

Mahabadi et al.

[11] Patent Number: 5,288,585

[45] Date of Patent: Feb. 22, 1994

[54] PROCESSES FOR THE PREPARATION OF POLYMERS

[75] Inventors: Hadi K. Mahabadi, Toronto; Michael Cunningham, Georgetown; Denise Y. Wright, Mississauga, all of Canada

[73] Assignee: Xerox Corporation, Stamford, Conn.

[21] Appl. No.: 872,197

[22] Filed: Apr. 23, 1992

[51] Int. Cl.[5] ..... G03G 9/087

[52] U.S. Cl. ..... 430/137

[58] Field of Search ..... 430/137, 138; 526/194

[56] References Cited

U.S. PATENT DOCUMENTS

| | | | |
|---|---|---|---|
| 3,954,898 | 5/1976 | Hirota et al. | 260/837 R |
| 4,465,756 | 8/1984 | Mikami et al. | 430/138 |
| 4,486,559 | 12/1984 | Murata et al. | 523/468 |
| 4,592,990 | 6/1986 | Takagi et al. | 430/137 |
| 4,727,011 | 2/1988 | Mahabadi et al. | 430/138 |
| 4,816,366 | 3/1989 | Hyosu et al. | 430/137 |
| 5,043,404 | 8/1991 | Mahabadi et al. | 526/194 |
| 5,135,832 | 8/1992 | Sacripante et al. | 430/138 |

*Primary Examiner*—John Goodrow

*Attorney, Agent, or Firm*—E. O. Palazzo

[57] ABSTRACT

A process for the preparation of a toner composition which comprises (1) mixing a water soluble monomer or monomers, and an oil soluble monomer or monomers with polymerization initiators, a crosslinking component and a chain transfer component; (2) effecting bulk polymerization until from about 10 to about 40 weight percent of the water soluble and oil soluble monomer or monomers have been polymerized; (3) cooling the product obtained; (4) mixing with the aforesaid partially polymerized product components comprised of charge control agents, pigments, dyes, initiators, chain transfer agents and crosslinking agents to formulate a uniform organic phase; (5) dispersing the organic phase into from between about 2 to about 5 times its volume of water containing from between about 1 to about 5 weight percent of a stabilizing component to form a suspension with an average particle size of from between about 5 to about 25 microns and a particle size distribution of from about 1.1 to about; and (6) suspension polymerizing to complete the conversion of said monomer, or said monomers to polymer.

23 Claims, No Drawings

PROCESSES FOR THE PREPARATION OF POLYMERS

BACKGROUND OF THE INVENTION

This invention is generally directed to processes for the preparation of a polymer or polymers, and toner compositions thereof, and more specifically to bulk and semisuspension polymerization processes. In one specific embodiment, the present invention is directed to economical and noncomplex processes for the preparation of polymers containing both a water soluble, and an oil soluble component. Also, in embodiments the present invention relates to processes for obtaining polymers containing two or more monomers, at least one of which is water soluble, and at least one of which is oil soluble by the combination of bulk polymerization, and suspension polymerization. The polymer or polymers resulting can be selected as toner resins for toner compositions, reference U.S. Pat. No. 4,338,390, the disclosure of which is totally incorporated herein by reference, as carrier coatings, toner additives, and the like. In embodiments, the polymer particles obtained with the processes of the present invention can possess an average particle diameter of from between about submicron, for example 0.1 micron to about 350 microns, and preferably from between about 1 to about 20 microns.

Copolymers and terpolymers containing at least one water soluble component, and one oil soluble component cannot be effectively obtained by known heterogeneous polymerizations because, for example, of the solubility of the hydrophilic component in the continuous phase. Water-soluble monomer refers in embodiments to monomers having greater than about 10 weight percent solubility in water and oil-soluble monomer refers in embodiments to those monomers having less than about 10 weight percent solubility in water. Consequently, such polymers are usually prepared by solution polymerizations, which are economically less attractive than heterogeneous processes in view of, for example, the lower polymerization rates, inferior heat transfer, and increased costs because of the use of a solvent and its removal. It is desirable to incorporate water soluble monomers into a polymer product to, for example, increase the range of its electrical and physical properties, for example, to effect the modification of the triboelectric characteristics of the polymer, and control the tribo properties of toner compositions thereof.

Semisuspension polymerization processes for the preparation of polymers are illustrated in U.S. Pat. No. 5,043,404, the disclosure of which is totally incorporated herein by reference. Also, U.S. Pat. No. 3,954,898 relates generally to specific bulk and suspension polymerizations, see the Abstract for example; and 4,592,990 relates to toner processes, see column 8 for example.

Disclosed in copending patent application U.S. Ser. No. 339,539 (D/88092), the disclosure of which is totally incorporated herein by reference, are semisuspension polymerization processes for the economical preparation of toners with, for example, an average diameter of from about 5 to about 25 microns, wherein a mixture of monomer or comonomers, a polymerization initiator, a crosslinking component and a chain transfer component are bulk polymerized until partial polymerization is accomplished, for example from about 10 to about 40 percent of monomer or comonomers is converted to a polymer, followed by adding to the formed partially polymerized polymer pigments, or dyes optional additives such as charge control materials, low molecular weight waxes such as polypropylene, or polyethylene, and the like, and mixing with, for example, a high shear mixer to obtain a homogeneous organic mixture, subsequently dispersing the resulting organic mixture in water containing a stabilizing component, which dispersing can be accomplished, for example, by a high shear mixer, transferring the resulting suspension to a reactor, and effecting polymerization thereof, followed by optional washing, and drying. The toner composition obtained can be optionally blended with surface additives, which may function as flow aids, such as colloidal silicas and the like.

As a result of a patentability search in the aforementioned copending patent application there were located U.S. Pat. No. 4,486,559, which discloses the incorporation of a prepolymer into a monomer toner mix followed by emulsion polymerization; U.S. Pat. Nos. 4,680,200 and 4,702,988, which illustrate emulsion polymerization. Also, U.S. Pat. No. 2,886,553 relates to polymerization processes.

Toners can generally be prepared by fusion mixing of pigments (colorants), charge control agents and other additives into thermoplastic resins to disperse them uniformly therein. In view of the high viscosity of the aforementioned mixture, a considerable amount of energy is usually needed to achieve a uniform dispersion of pigments and other additives in the toner resin. The mixture is then cooled, followed by pulverization and classification into desired particles sizes and particle size distribution. It is known that pulverization is an energy intensive step in this process. This preparation method is capable of producing excellent toners, however, it requires the use of a several steps which can be costly, energy intensive and limited in certain respects. In the process for generating toners by pulverization, the material being pulverized must usually be fragile to permit it to be readily pulverized. Therefore, some thermoplastic resins which are not fragile but have acceptable fusing performance may not be selected for the aforementioned prior art processes. Also, if the material being pulverized is too fragile, it may be excessively micropulverized and, therefore, the fines portion of the particles must usually be uneconomically removed. These limitations become increasingly severe for smaller particle size toners, that is with for example a volume average particle size of from about 3 to about 9 microns. Also, when a material such as a polymer resin with a low melting point is employed to improve fusing performance of the toner, the fusion of such material may occur in the pulverizing device or the classifier.

Attempts to prepare copolymers or terpolymers containing a significant portion of water-soluble monomer by traditional suspension polymerizations are prone to failure because the water-soluble components will rapidly diffuse into the aqueous phase, leaving only the oil-soluble monomers in the polymerizing particles. The water-soluble monomers will then solution polymerize in the aqueous phase if a source of free radicals is available. However, if the initial viscosity of the suspended droplets is sufficiently high, and for example if the conversion is between approximately 10 to 40 percent depending on the molecular weight, which varies from about 10,000 to 200,000, the diffusion rate of the water-soluble components will be severely hindered. As a result, these monomers will polymerize in the droplets before they have an opportunity to diffuse into the aqueous phase. The higher the initial viscosity the more restricted is the monomer diffusion; however if the initial viscosity is too high it will not be possible to effectively form small particles with a narrow particle size distribution.

Accordingly, to remove or minimize the disadvantage of the pulverization method, there have been proposed processes for producing toner wherein the toner particles were formed and the desired particle size distribution produced in a reactor. These processes include dispersion polymerization, suspension polymerization, emulsion polymerization, and the like. Disclosed in U.S. Pat. No. 4,486,559 is the preparation of a toner composition by the incorporation of a prepolymer into a monomer/pigment mixture, followed by emulsion polymerization, see for example columns 4, 5 and 8 of this patent. Also, methods of preparing toner, including suspension/dispersion polymerization, are illustrated in columns 1 and 2 of this patent. In these processes, the pigment and additives such as charge control components are added to a monomer, or comonomers prior to polymerization. Particle formation is achieved by the dispersion of the pigmented monomer or comonomers in a continuous phase such as water, and the droplets of pigmented monomers are then polymerized to form toner particles. One advantage of these processes as compared to other methods is the elimination of fusion mixing (Banbury/extruder) and pulverization classification processing. Nevertheless, it can be difficult with these processes to accomplish polymerization of pigmented monomer droplets in a diameter range of 5 to 25 microns with a narrow distribution of, for example, 1.3. Also, suspension failure is common with these processes especially when the monomer droplet diameter is less than 50 microns and as polymerization proceeds in the sticky region (10 to 40 percent conversion). Further, it is difficult to conduct the polymerization of pigmented monomer droplets since, for example, it is known that polymerization of free radical type monomers are hindered, and may be prevented by the presence of various pigments, especially carbon black. Another disadvantage of these processes for the preparation of toners resides in the resulting poor dispersion of the pigment and other additives within the toner particles which is believed to be caused by the lack of micromixing, that is the diffusional mixing within the monomer droplet. Moreover, many of the prior art processes for the preparation of polymer particles is costly, or not as economical as desired. These and other disadvantages are avoided or minimized with the bulk, and semisuspension polymerization processes of the present invention.

SUMMARY OF THE INVENTION

It is, therefore, an object of this invention to provide processes for the preparation of polymers with many of the advantages illustrated herein.

In another object of the present invention there are provided simple and economical processes for the preparation of polymers with an oil soluble component and a water soluble component.

Another object of the present invention resides in simple and economical processes for the preparation of polymers with narrow particle size distribution, and an average volume diameter of from about 0.1 to about 300 microns and more preferably from 1 to about 20 microns.

Further, another object of the present invention resides in simple and economical processes for the preparation of low cost, black and colored toners with an average particle size diameter of from about 5 to about 25 microns, and narrow particle size distributions.

Additionally, in another object of the present invention there are provided simple and economical processes for the preparation of black and colored toner particles with an average particle size diameter of 5 to 25 microns, a narrow particle size distribution, high effective pigment dispersion, excellent effective dispersion of other additives within the toner particles, and a high degree of flexibility in controlling molecular weight and molecular weight distribution of the toner resin without use of pulverization/classification, and wherein the toner contains the polymer obtained with the bulk semisuspension processes illustrated herein.

These and other objects of the present invention are accomplished in embodiments by the provision of processes for the preparation of polymers and toners, and more specifically to bulk, semisuspension processes wherein polymers containing at least one water soluble component, and a least one oil soluble component are obtained. In one embodiment, the process of the present invention comprises the bulk polymerization of comonomers containing at least one water soluble monomer with a suitable initiator/catalyst up to a conversion, that is at about the onset of the formation of a gel; cooling the partially polymerized monomer obtained; adding, including polymerization compounds, other components thereto, such as pigments (colorants), charge control agents, initiators, crosslinking agents or chain transfer agents; dispersing the resulting organic phase into an aqueous phase comprised of water and a stabilizer and optionally an aqueous phase inhibitor; heating the resulting mixture to initiate polymerization (semisuspension polymerization); maintaining the temperature of the mixture at about 50° to about 120° C. and more preferably from about 60° to about 80° C. for about 4 to about 12 hours until monomer conversion is complete as can be determined from knowledge of the polymerization kinetics, and other known means; and subsequently washing, filtering, and drying the polymer and toner products obtained.

The bulk polymerization involves the following specific steps in embodiments of the present invention: initiators, chain transfer agents and crosslinking agents are dissolved in the desired monomers, and the mixture is then heated to from about 50° to about 120° C. to initiate the polymerization. When the desired conversion, for example from 10 to 40 percent is reached, as determined for example by a densitometer, the polymerization is quenched by immersion in a cold water, or a cooled oil bath or by changing the temperature of coolant flowing through the reaction cooling jacket until the temperature of the reaction mixture is reduced to less than 10° C.

The second polymerization, or suspension polymerization comprises the following steps in embodiments: mixing the aforementioned partially polymerized mixture with desired additives such as optional charge control agents, optional pigments (colorants), chain transfer agents, crosslinking agents and initiators with, for example, a high shear homogenizer to form a uniform organic phase; dispersing the organic phase in water containing a stabilizing component and optionally an aqueous phase inhibitor with, for example, a high shear mixer to produce a narrow particle size polymer suspension, for example having a geometric standard deviation of 1.10 to 1.35; polymerizing the suspension product, followed by cooling and isolating the toner with polymer product. The toner with polymer can then be washed with water, and dried by, for example, heating at temperatures from 40° to 120° C.

More specifically, the process of the present invention is comprised of (1) mixing a water soluble monomer or comonomers, and an oil soluble monomer with polymerization initiators, a crosslinking component and a chain transfer component; (2) effecting bulk polymerization by increasing the temperature of the mixture to from about 50° C. to about 120° C. and more preferably from 60° to 80° C. until from about 10 to about 40 weight percent of the water-soluble and oil-soluble monomer or comonomers have been polymerized; (3) cooling the product obtained; (4) mixing with the aforesaid partially polymerized monomer product components such as toner pigments like carbon black such as REGAL 330®, charge control agents, chain transfer agents, crosslinking agents and initiators using a high shear mixer to formulate a uniform organic phase; (5) dispersing the organic phase into from 2 to about 5 times its volume of water containing from about 1 to about 5 weight percent of a stabilizing component to form a suspension with an average particle size of from about 5 to about 25 microns and a particle size distribution of from about 1.1 to about 1.3 using a high shear mixer; (6) transferring the resulting suspension to a reactor and polymerizing by increasing the process temperature to from about 55° to about 120° C. to complete the conversion of monomer or comonomers to polymer product; (7) washing the toner with polymer with water and/or an alkylalcohol with from 1 to about 10 carbon atoms, such as methanol; (8) separating the toner particles by, for example, filtration or centrifugation; and (9) drying by, for example, heating in an oven at about 75° C. the particles obtained. The polymer or toner obtained can be blended with flow additives such as colloidal silica.

Also, the process of the present invention is directed to the preparation of black and colored toner particles with an average particle diameter of from about 5 microns to about 25 microns and with resin binders synthesized to have a selected desirable average molecular weight, for example a number average molecular weight of from about 5,000 to about 500,000, a weight average molecular weight, of from about 10,000 to about 2,000,000, and a desired selected required molecular weight distribution of, for example, a molecular weight distribution with from about one to about four peaks. Further, the process of the present invention is directed to the preparation of black and colored toner particles of an average diameter of from about 5 microns to about 25 microns, a particle size distribution of from 1.1 to about 1.3 with the resin binder having a number average molecular weight in the range of 5,000 to about 100,000; a weight average molecular weight of 25,000 to about 400,000; and a molecular weight distribution having one to 3 peaks.

The process of the present invention in embodiments comprises (1) mixing a water soluble monomer or comonomers, and an oil soluble monomer with polymerization initiators with the ratio of monomer or comonomers to initiator being from about 100/2 to about 100/20, a crosslinking component with the ratio of monomer or comonomers to crosslinking component being from about 100/0.1 to about 100/5, and a chain transfer component with the ratio of monomer or comonomers to the chain transfer component being from about 100/0.01 to about 100/1; (2) effecting bulk polymerization by increasing the temperature of the mixture to from about 50° C. to about 120° C. until from about 10 to about 40 weight percent of the water soluble and oil soluble monomer or comonomers have been polymerized to a polymer with a number average molecular weight of from 5,000 to about 50,000 and weight average molecular weight from about 10,000 to about 200,000; (3) cooling the product obtained; (4) mixing, such as with a high shear mixer, with the aforesaid partially polymerized monomer product polymerization components to formulate a uniform organic phase; (5) dispersing the organic phase into from 2 to about 5 times its volume of water containing from about 1 to about 5 weight percent of a stabilizing component, preferably polyvinyl alcohol with a weight average molecular weight of from 1,000 to about 10,000 to form a suspension with an average particle size of from about 5 to about 25 microns and a particle size distribution of from about 1.1 to about 1.3 using a high shear mixer; (6) transferring the resulting suspension to a reaction vessel and polymerizing the contents by increasing the process temperature to from about 55° to about 120° C. to complete the conversion of monomer or comonomers to polymer product; (7) washing the product with water and/or an alkylalcohol, such as methanol, 3 to 5 times; (8) separating the polymer particles by, for example, filtration or centrifugation; and (9) drying by, for example, heating in an oven at about 75° C. the polymer particles obtained.

Illustrative examples of oil-soluble monomer, monomers or comonomers selected for the processes of the present invention and present in effective amounts as illustrated herein, for example, include vinyl monomers of styrene and its derivatives such as styrene, α-methylstyrene, p-chlorostyrene and the like; monocarboxylic acids and their derivatives such as methyl acrylate, ethyl acrylate, butyl acrylate, dodecyl acrylate, octyl acrylate, phenyl acrylate, methyl methacrylate, ethyl methacrylate, butyl methacrylate, octyl methacrylate; dicarboxylic acids having a double bond and their derivatives such as monobutyl maleate, dibutyl maleate; vinyl esters such as vinyl chloride, vinyl acetate and vinyl benzoate; and vinyl ethyl ether and vinyl isobutyl ether; vinyl naphthalene; unsaturated monoolefins such as isobutylene and the like; vinylidene halides such as vinylidene chloride and the like; and mixtures thereof.

Illustrative examples of water-soluble monomer, monomers or comonomers selected for the processes of the present invention and present in effective amounts as illustrated herein, for example, include acrylic acids, methacrylic acids, acrylamide, acrylonitrile, ethylene oxide, N-vinyl pyrrolidinone, maleic acid, vinylsulfonic acid, styrenesulfonic acid, 2-acrylamido-2-methylpropanesulfonic acid, 3-vinyloxypropane-1-sulfonic acid, 2-methacryloyoxy ethanesulfonate, 3-methyacryloyoxy-2-hydroxypropanesulfonate, 2-acrylamido-2-methyl propanesulfonate, 3-sulfo-2-hydroxypropyl methacrylate, vinylphosphonic acid, 4-vinylphenol, N-vinylsuccinimidic acid; diallyldimethylammonium chloride, diallyldiethylammonium chloride, diethylaminoethyl methacrylate, dimethylaminoethyl methacrylate, methacryloyoxyethyltrimethylammonium sulfate methacryloyoxyethyltrimethylammonium chloride, 3-(methacrylamido)propyltrimethylammonium chloride; or mixtures thereof.

Examples of initiators present in effective amounts as illustrated herein, for example, include azo and diazo compounds such as azoisobutyronitrile, azodimethylvaleronitrile, azobiscyclohexanitrile, 2-methylbutyronitrile, diazoamine-azobenzene, mixtures thereof, and the like. The bulk polymerization temperature should be selected according to the initiator types, but is typically in the range of 40° to 95° C. Generally, the molecular weight of polymer decreases as the amount of initiator or polymerization temperature increases. For example, the molecular weight could be reduced from 80,000 to 40,000 if initiator concentration was increased from 1 percent to 4 percent or the temperature was increased from 50° C. to 70° C. The bulk polymerization temperature, initiator types and concentration should be selected in embodiments to obtain partially polymerized monomer with 10 to 40 percent polymer having weight average molecular weight in the range of 10,000 to about 200,000. This polymer will assist in the dispersion of pigment and also can coat the pigment particle and, therefore, minimize the inhibition effects of pigment on the suspension polymerization.

The polymer should preferably be partially crosslinked to some extent, for example from 1 to 40 percent, to provide, for example, when used as a toner component improved toner and/or image anti-offset characteristics. Examples of crosslinkers selected for the process of the present invention include compounds having two or more polymerizable double bonds. Specific examples of such compounds include aromatic divinyl compounds such as divinylbenzene and divinylnaphthalene; carboxylic acid esters with two double bounds such as ethylene glycol diacrylate, ethylene glycol dimethylacrylate and like; divinyl compounds such as divinyl ether, divinyl sulfide, divinyl sulfone and the like. The crosslinking component should preferably be present in an amount of from about 0.1 to about 5 parts by weight in 100 parts by weight of monomer or comonomer mixture.

Stabilizer present in effective amounts as illustrated herein, for example, and selected for the process of the present invention include nonionic and ionic water soluble polymeric stabilizers such as methyl cellulose, ethyl cellulose, hydroxypropyl cellulose, block copolymers such as PLURONIC E87 TM available from BASF, the sodium salts of carboxyl methyl cellulose, polyacrylate acids and their salts, polyvinyl alcohol, gelatins, starches, gums, alginates, zein, casein and the like; and barrier stabilizers such as tricalcium phosphate, talc, barium sulfate and the like.

The chain transfer component selected functions to control molecular weight by inhibiting chain growth. Typical chain transfer agents utilized for the process of the present invention are mercaptans such as laurylmercaptan, butylmercaptan and the like, or halogenated carbons such as carbon tetrachloride or carbon tetrabromide and the like. The chain transfer agent should preferably be present in an amount of from about 0.01 to about 1 weight percent of monomer or comonomer mixture.

Typical well known suitable pigments can be selected as the colorant for the toner containing the polymers obtained with the processes of the present invention including, for example, carbon black, like Cl Pigment Black 7, REGAL 330® nigrosine dye, aniline blue, phthalocyanine derivatives, magnetites and mixtures thereof. The pigment, which is preferably a known carbon black, should be present in a sufficient amount to render the composition colored thereby permitting the formation of a clearly visible image. Generally, the pigment particles are present in amounts of from about 3 percent by weight to about 20 percent by weight, based on the total weight of the toner composition, however, lesser or greater amounts of pigment particles may be selected.

When the pigment particles are comprised of magnetites, including those commercially available as Cl Pigment Black 11, and MAPICO BLACK TM they are present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black. Particularly preferred as pigments in embodiments are magnetites as they enable, for example, images with no toner spots for extended time periods exceeding the development of 100,000 images, which corresponds to about 400,000 imaging cycles for a panel containing four imaging members.

Also included within the scope of the present invention are colored toner compositions containing as pigments or colorants red, blue, green, brown, magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the Color Index as Cl 60710, Cl Dispersed Red 15, a diazo dye identified in the Color Index as Cl 26050, Cl Solvent Red 10, Cl Pigment Red 48, Cl Pigment Red 122, and the like. Illustrative examples of cyan materials that may be used as pigments include copper tetra-4 (octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Cl Pigment Blue 19, Cl Solvent Blue 79, and the like; while illustrative examples of yellow pigments that may be selected include diarylide yellow 3,3-dichlorobenzidene acetoacetanilides, a monazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Cl Pigment Yellow 31 and the like. These pigments are generally present in the toner composition in an amount of from about 2 weight percent to about 15 weight percent based on the weight of the toner resin particles.

Illustrative examples of optional charge enhancing additives present in various effective amounts, such as, for example, from about 0.1 to about 20 percent by weight, and preferably from about 1 to about 3 weight percent include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives.

The toner components can be added during the preparation of the polymer or subsequent thereto in embodiments.

With further respect to the process of the present invention, the stabilizer on the surface of the toner particles can, if desired, be substantially removed by washing with an alcohol including, for example, methanol, or water. Separation of the washed toner particles from solution can be achieved by selecting various known classical separation technique such as filtration, centrifugation and the like. Known drying technique such as vacuum drying, freeze drying, spray drying, fluid bed drying and the like can be selected for drying the toner.

Embodiments of the present invention include a process for the preparation of a polymer or polymers which comprises the bulk polymerization of monomers containing at least one water soluble monomer, and one oil soluble monomer with a suitable initiator until there results from between about 10 to about 40 weight percent of conversion of the monomers to polymer or polymers, wherein the water-soluble monomer possess a solubility in water of from about 10 to 100 weight percent, and the oil-soluble monomer possesses a solubility in water of from about 0.1 to 10 weight percent; cooling the partially polymerized polymer or polymers; adding polymerization components thereto; dispersing the resulting organic phase into an aqueous phase comprised of water and a stabilizer; heating the resulting mixture to initiate polymerization; maintaining the temperature of the mixture at from between about 50° and about 120° C. until monomer to polymer or polymers conversion is equal to or greater than 85 percent; a process for the preparation of a toner composition which comprises (1) mixing a water soluble monomer or monomers, and an oil soluble monomer or monomers with polymerization initiators, a crosslinking component and a chain transfer component; (2) effecting bulk polymerization until from about 10 to about 40 weight percent of the water soluble and oil soluble monomer or monomers have been polymerized; (3) cooling the product obtained; (4) mixing with the aforesaid partially polymerized product polymerization components comprised of charge control agents, pigments, dyes, initiators, chain transfer agents and crosslinking agents to formulate a uniform organic phase; (5) dispersing the organic phase into from between about 2 to about 5 times its volume of water containing from between about 1 to about 5 weight percent of a stabilizing component to form a suspension with an average particle size of from between about 5 to about 25 microns and a particle size distribution of from about 1.1 to about; (6) suspension polymerizing to complete the conversion of said monomer, or said monomers to polymer; (7) washing the toner product containing said polymer with water and/or an alcohol; (8) isolating the toner composition; and (9) drying; and a process for the preparation of a toner composition which comprises (1) mixing a water soluble monomer or monomers, and an oil soluble monomer or monomers with polymerization initiators, a crosslinking component and a chain transfer component; (2) effecting bulk polymerization until from about 10 to about 40 weight percent of the water soluble and oil soluble monomer or monomers have been polymerized; (3) cooling the product obtained; (4) mixing with the aforesaid partially polymerized product polymerization components comprised of charge control agents, pigments, dyes, initiators, chain transfer agents and crosslinking agents to formulate a uniform organic phase; (5) dispersing the organic phase into from between about 2 to about 5 times its volume of water containing from between about 2 to about 5 weight percent of a stabilizing component to form a suspension with an average particle size of from between about 5 to about 25 microns and a particle size distribution of from about 1.1 to about; and (6) suspension polymerizing to complete the conversion of said monomer, or said monomers to polymer.

The following Examples are being submitted to illustrate embodiments of the present invention. These Examples are intended to be illustrative only and are not intended to limit the scope of the present invention. Also, parts and percentages are by weight unless otherwise indicated. A comparative Example is also provided.

EXAMPLE I

To 96 grams of styrene monomer contained in a 500 milliliter reaction vessel were added 24 grams of acrylic acid monomer and 2.0 grams of azobisisobutyronitrile, which components were mixed until dissolved. This mixture was then bulk polymerized by heating in a 250 milliliter glass reactor to 60° C. by means of an oil bath while the mixture was stirred with a TEFLON® propeller until 15 percent of the styrene and acrylic acid monomers were converted to the corresponding styrene/acrylic acid copolymer. To the resulting comonomer/copolymer mixture were then added 4.0 grams of azobis(dimethylvaleronitrile), 2.0 grams of azobisisobutyronitrile and 0.6 gram of divinylbenzene crosslinking agent followed by mixing with a Brinkmann PT456G high shear homogenizer with 10,000 revolutions per minute for 2 minutes to form a uniform organic phase of styrene, acrylic acid, the copolymer of styrene/acrylic acid formed in the bulk polymerization, the initiators azobis(dimethylvaleronitrile) and azobisisobutyronitrile and the crosslinking agent divinylbenzene. The uniform organic phase was then poured together with 440 milliliters of water containing 4.0 weight percent of polyvinylalcohol with a weight average molecular weight of 3,000 into a four liter stainless steel beaker. The beaker was placed in an ice bath and using a Brinkmann PT456G polytron homogenizer the mixture was then vigorously stirred at 10,000 revolutions per minute for 5 minutes to provide a microsuspension of polymer particles in water. The suspension was then transferred to a 1 liter glass reactor equipped with a TEFLON® propeller with a stirring speed of 300 revolutions per minute and the content of the reactor was heated to 60° C. and controlled at that temperature by means of an oil bath. After four hours, the suspension polymerization was complete, and the resulting product was poured into two liters of hot water. The resulting diluted suspension was then stirred for 15 minutes. The supernatant liquid comprised of the diluted polyvinyl alcohol was decanted, fresh water was added and the mixture was stirred for 15 minutes to disperse the product particles. This washing procedure was repeated four times with deionized water. After the final wash, the slurry was poured into a tray and vacuum dried to yield clean, dry individual polymer particles of a copolymer of 80 percent of styrene and 20 percent of acrylic acid. Using a scanning electron microscope, photomicrographs of the dry product were taken and evidenced an average volume particle size diameter of 1 micron. As measured by gel permeation chromatography of the dried product, the number average molecular weight of the styrene acrylic acid resin was 66,000 and the weight average molecular weight was 240,000. Compositional analysis of this resin conducted by nuclear magnetic resonance revealed the resin had a composition of 81 weight percent of styrene and 19 weight percent of acrylic acid compared to a theoretical prediction of 80 percent and 20 percent respectively.

EXAMPLE II

The process of Example I was repeated except that 78 grams of styrene monomer and 42 grams of acrylic acid monomer were used. The resulting product had an average volume particle diameter size of 0.7 micron as determined by scanning electron microscopy. The number and weight average molecular weights of the final product were determined by gel permeation chromatography to be 83,000 and 276,000, respectively. Compositional analysis conducted by nuclear magnetic resonance revealed the final polymer had a composition of 66 weight percent styrene and 34 weight percent acrylic acid compared to a theoretical prediction of 65 percent and 35 percent, respectively.

EXAMPLE III

The process of Example I was repeated except that 60 grams of styrene and 60 grams of acrylic acid were used. The resulting product had an average volume particle diameter size of 0.5 micron as determined by scanning electron microscopy. The number and weight average molecular weights of the final product were determined by gel permeation chromatography to be 109,000 and 345,000, respectively. Compositional analysis conducted by nuclear magnetic resonance revealed the final resin had a composition of 52 weight percent styrene and 48 weight percent acrylic acid, compared to a theoretical prediction of 50 percent and 50 percent, respectively.

EXAMPLE IV

To 96 grams of styrene and 24 grams of acrylic acid in a 500 milliliter reaction vessel were added 4.0 grams of azobisisobutyronitrile, 4.0 grams of azobis(dimethylvaleronitrile) and 0.6 gram of divinylbenzene. These components were mixed until dissolved. No bulk polymerization was conducted. This organic phase was then poured together with 440 milliliters of water containing 4.0 weight percent polyvinyl alcohol having a weight average molecular weight of 3,000 into a four liter stainless steel beaker. The beaker was placed in an ice bath and using a Brinkmann PT456G polytron homogenizer the mixture was then vigorously stirred at 10,000 revolutions per minute for 5 minutes to provide a microsuspension of polymer particles in water. The suspension was then transferred to a 1 liter glass reactor equipped with a TEFLON® propeller with a stirring speed of 300 revolutions per minute and the content of the reactor was heated to 60° C. and controlled at that temperature by means of an oil bath. After 60 minutes, the suspension was observed to have failed as evidenced by it coagulating into a large mass of copolymer in the reactor.

EXAMPLE V

The process of Example I was repeated except that the organic phase was dispersed in water containing 0.25 weight percent of polyvinyl alcohol of a molecular weight 125,000. The resulting product had an average particle size diameter of 12.5 microns. The other characteristics of the prepared resin were substantially equivalent to the resin of Example I.

EXAMPLE VI

The process of Example I was repeated except that the organic phase was dispersed in water containing 0.75 weight percent of hydroxypropyl cellulose. The resulting product had an average particle size diameter of 7 microns. The other characteristics of the prepared resin were substantially equivalent to the resin of Example I.

EXAMPLE VII

The process of Example I was repeated except that 96 grams of styrene and 24 grams of methacrylic acid were used. The resulting product had an average particle diameter size of 0.6 micron as determined by scanning electron microscopy. The number and weight average molecular weight of the final resin product were determined by gel permeation chromatography to be 101,000 and 314,000, respectively. Compositional analysis conducted by nuclear magnetic resonance revealed the final resin had a composition of 79 weight percent styrene and 21 weight percent methacrylic acid, compared to a theoretical prediction of 80 percent and 20 percent, respectively.

EXAMPLE VIII

To 60 grams of styrene monomer and 36 grams of n-butyl methacrylate monomer were added 24 grams of acrylic acid monomer and 2.0 grams of azobisisobutyronitrile, which components were mixed until dissolved. Six grams of the pigment carbon black, CI Pigment Black 11, were added to this solution, and the resulting solution was stirred at 10,000 revolutions per minute for 1 minute using a high shear mixer in order to disperse the carbon black uniformly. This mixture was then bulk polymerized by heating in a 250 milliliter glass reactor to 60° C. by means of an oil bath while the mixture was stirred with a TEFLON® propeller until 15 percent of the monomers were converted to a terpolymer, as determined by gravimetry. To this mixture comprised of styrene, n-butyl methacrylate, acrylic acid, the terpolymer formed from styrene, n-butyl methacrylate and acrylic acid, azobisisobutyronitrile, and carbon black, were then added 4.0 grams of azobis(dimethylvaleronitrile), 2.0 grams of azobisisobutyronitrile and 0.6 gram of divinylbenzene followed by mixing with a Brinkmann PT456G high shear homogenizer with 10,000 revolutions per minute for 2 minutes to form a uniform organic phase. The uniform organic phase was then poured together with 440 milliliters of water containing 0.75 weight percent of hydroxypropyl cellulose, into a four liter stainless steel beaker. The beaker was placed in an ice bath and using a Brinkmann PT456G polytron homogenizer the mixture was then vigorously stirred at 10,000 revolutions per minute for 4 minutes to provide a microsuspension of toner particles in water. The suspension was then transferred to a 1 liter glass reactor equipped with a TEFLON® propeller with a stirring speed of 300 revolutions per minute and the content of the reactor was heated to 60° C. and controlled at that temperature by means of an oil bath. After four hours, the suspension polymerization was complete, and the resulting product was poured into two liters of hot water. The resulting diluted suspension was then stirred for 15 minutes. The supernatant liquid comprised of the diluted hydroxypropyl cellulose was decanted, fresh water was added and the mixture was stirred for 15 minutes to disperse the particles. This washing procedure was repeated four times with deionized water. After the final wash, the slurry was poured into a tray and vacuum dried to yield clean, dry individual toner particles. Using a scanning electron microscope, photomicrographs of the dry toner comprised 95 percent of the partially crosslinked terpolymer of styrene, n-butyl methacrylate and acrylic acid in the ratio 50/30/20 and 5 percent of the carbon black product were taken and evidenced an average particle size diameter of 7 microns. As measured by gel permeation chromatography, the number average molecular weight of the styrene, n-butyl methacrylate, acrylic acid terpolymer resin was 54,000 and the weight average molecular weight was 204,000. Compositional analysis conducted by nuclear magnetic resonance revealed the aforementioned terpolymer resin had a composition of 48 weight percent styrene, 31 percent n-butyl methacrylate and 21 weight percent acrylic acid, compared to a theoretical prediction of 50 percent, 30 percent and 20 percent, respectively.

EXAMPLE IX

Example VIII was repeated except that the Pigment Blue 15 was used instead of the carbon black. The final particle size was 5.5 microns. The other characteristics of the prepared resin and toner were substantially equivalent to those of Example VIII.

The onset of the gel effect, for example the point at which the bulk polymerization is accomplished, is determined by a known equation, reference copending patent application U.S. Ser. No. 858,451 (D/91653), titled Processes For The Preparation of Toners, the disclosure of which is totally incorporated herein by reference.

Other modifications of the present invention may occur to those skilled in the art subsequent to a review of the present application, and these modifications are intended to be included within the scope of the present invention.

What is claimed is:

1. A process for the preparation of a toner composition consisting essentially of (1) mixing a water soluble monomer or monomers, and an oil soluble monomer or monomers with optional polymerization initiators, an optional crosslinking component and an optional chain transfer component; (2) effecting bulk polymerization until from about 10 to about 40 weight percent of the water soluble and oil soluble monomer or monomers have been polymerized; (3) cooling the product obtained; (4) mixing with the aforesaid partially polymerized product components comprised of charge control agents, pigments, or dyes to formulate a uniform organic phase; (5) dispersing the organic phase into from between about 2 to about 5 times its volume of water containing from between about 1 to about 5 weight percent of a stabilizing component to form a suspension with an average particle size of from between about 5 to about 25 microns and a particle size distribution of from about 1.1 to about; (6) suspension polymerizing to complete the conversion of said monomer, or said monomers to polymer; (7) washing the toner product containing said polymer with water and/or an alcohol; (8) isolating the toner composition; and (9) drying; and wherein said monomer or monomers are styrene, monocarboxylic acids and the derivatives thereof; dicarboxylic acids with a double bond; vinyl esters; vinyl ketones; vinyl naphthalene; unsaturated mono-olefins; vinylidene halides; sulfonic acids or sulfonates; and mixtures thereof.

2. A process in accordance with claim 1 wherein the monomer or monomers are styrene, monocarboxylic acids and the derivatives thereof; dicarboxylic acids with a double bond; vinyl esters; vinyl ketones; vinyl naphthalene; unsaturated mono-olefins; vinylidene halides; sulfonic acids or sulfonates; and mixtures thereof.

3. A process in accordance with claim 1 wherein the oilsoluble monomer or monomers are styrene, α-methylstyrene, p-chlorostyrene, methyl acrylate, ethyl acrylate, butyl acrylate, dodecyl acrylate, octyl acrylate, phenyl acrylate, methyl methacrylate, ethyl methacrylate, butyl methacrylate, octyl methacrylate, monobutyl maleate, dibutylmaleate, vinyl chloride, vinyl acetate, vinyl benzoate, vinyl ethyl ether vinyl isobutyl ether, isobutylene, vinylidene chloride, or mixtures thereof.

4. A process in accordance with claim 1 wherein the water-soluble monomer or monomers are acrylic acids, methacrylic acids, acrylamide, acrylonitrile, ethylene oxide, N-vinyl pyrrolidinone, maleic acid, vinylsulfonic acid, styrenesulfonic acid, 2-acrylamido-2-methylpropanesulfonic acid, 3-vinyloxypropane-1-sulfonic acid, 2-methacryloyoxy ethanesulfonate, 3-methyacryloyoxy-2-hydroxypropanesulfonate, 2-acrylamido-2-methyl propanesulfonate, 3-sulfo-2-hydroxypropyl methacrylate, vinylphosphonic acid, 4-vinylphenol, N-vinylsuccinimidic acid; diallyldimethylammonium chloride, diallyldiethylammonium chloride, diethylaminoethyl methacrylate, dimethylaminoethyl methacrylate, methacryloyoxyethyltrimethylammonium sulfate methacryloyoxyethyltrimethylammonium chloride, 3-(methacrylamido)propyltrimethylammonium chloride; or mixtures thereof.

5. A process in accordance with claim 1 wherein from 1 to about 10 monomer or monomers are selected.

6. A process in accordance with claim 1 wherein said polymer or polymers are of an average diameter of from about 0.1 to about 300 microns.

7. A process in accordance with claim 1 wherein the bulk and suspension polymerization is accomplished by heating to a temperature of from about 50° to about 120° C.

8. A process in accordance with claim 1 wherein the number and weight average molecular weight of the polymer or polymers prepared in the bulk polymerization step is from between about 5,000 to about 50,000 and from between about 10,000 to about 300,000, respectively.

9. A process in accordance with claim 1 wherein the molecular weight distribution of the polymer or polymers obtained has one peak, or a plurality of peaks.

10. A process in accordance with claim 1 wherein said mixing of (4) and the dispersion of the organic phase in the water containing stabilizing component is accomplished with a high shear homogenizer.

11. A process in accordance with claim 1 wherein the particle size and particle size distribution of the polymer or polymers is controlled by the mixing time, stabilizing concentration, and the viscosity of the organic phase during dispersion of the organic phase in the water containing stabilizing component.

12. A process in accordance with claim 1 wherein the oil-soluble monomer or monomers are vinyl monomers of styrene, α-methylstyrene, p-chlorostyrene, methyl acrylate, ethyl acrylate, butyl acrylate, dodecyl acrylate, octyl acrylate, phenyl acrylate, methyl methacrylate, ethyl methacrylate, butyl methacrylate, octyl methacrylate, monobutyl maleate, dibutylmaleate, vinyl chloride, vinyl acetate and vinyl benzoate; and vinyl ethyl ether and vinyl isobutyl ether; vinyl naphthalene; isobutylene, vinylidene chloride, and mixtures thereof, and the water soluble monomer(s) are acrylic acids, methacrylic acids, acrylamide, acrylonitrile, ethylene oxide, N-vinyl pyrrolidinone, maleic acid, vinylsulfonic acid, styrenesulfonic acid, 2-acrylamido-2-methylpropanesulfonic acid, 3-vinyloxypropane-1-sulfonic acid, 2-methacryloyoxy ethanesulfonate, 3-methyacryloyoxy-2-hydroxypropanesulfonate, 2-acrylamido-2-methyl propanesulfonate, 3-sulfo-2-hydroxypropyl methacrylate, vinylphosphonic acid, 4-vinylphenol, N-vinylsuccinimidic acid; diallyldimethylammonium chloride, diallyldiethylammonium chloride, diethylaminoethyl methacrylate, dimethylaminoethyl methacrylate, methacryloyoxyethyltrimethylammonium sulfate methacryloyoxyethyltrimethylammonium chloride, 3-(methacrylamido)propyltrimethylammonium chloride; or mixtures thereof.

13. A process in accordance with claim 1 wherein the initiators are selected from the group consisting of azo, diazo compounds, and mixtures thereof.

14. A process in accordance with claim 13 wherein the polymerization initiator is azoisobutyronitrile, azodimethylvaleronitrile, azobiscyclohexanitrile, 2-methylbutyronitrile, diazoamine-azobenzene, or mixtures thereof.

15. A process in accordance with claim 1 wherein the crosslinking component is selected from the group consisting of compounds having two or more polymerizable double bonds; and divinyl compounds.

16. A process in accordance with claim 1 wherein the crosslinking component is selected from the group consisting of ethylene glycol diacrylate, ethylene glycol dimethylacrylate, divinyl ether, divinyl sulfite, divinyl sulfone, divinylbenzene, and divinylnaphthalene; the chain transfer component is selected from the group consisting of mercaptans and halogenated hydrocarbons; and the stabilizing component is selected from the group consisting of nonionic and ionic water soluble polymeric stabilizers, polyvinyl alcohol, gelatins, starches, gums, alginates, zein and casein.

17. A process in accordance with claim 1 wherein the chain transfer agent is carbon tetrachloride, butylmercaptan, or laurylmercaptan.

18. A process in accordance with claim 1 wherein the stabilizing component is selected from the group consisting of methyl cellulose, ethyl cellulose, hydroxypropyl cellulose, tricalcium phosphate, talc and barium sulfate.

19. A process in accordance with claim 1 wherein the pigment is carbon black, magnetites, or cyan, magenta, yellow, blue, red or mixtures thereof.

20. A process in accordance with claim 1 wherein subsequent to polymer conversion said polymer is washed, filtered, and dried.

21. A process for the preparation of a toner composition consisting essentially of (1) mixing a water soluble monomer or monomers, and an oil soluble monomer or monomers with polymerization initiators, a crosslinking component and a chain transfer component; (2) effecting bulk polymerization until from about 10 to about 40 weight percent of the water soluble and oil soluble monomer or monomers have been polymerized; (3) cooling the product obtained; (4) mixing with the aforesaid partially polymerized product components comprised of charge control agents, pigments, dyes, initiators, chain transfer agents and crosslinking agents to formulate a uniform organic phase; (5) dispersing the organic phase into from between about 2 to about 5 times its volume of water containing from between about 1 to about 5 weight percent of a stabilizing component to form a suspension with an average particle size of from between about 5 to about 25 microns and a particle size distribution of from about 1.1 to about; and (6) suspension polymerizing to complete the conversion of said monomer, or said monomers to polymer; and wherein said monomer or monomers are styrene, monocarboxylic acids and the derivatives thereof; dicarboxylic acids with a double bond; vinyl esters; vinyl ketones; vinyl naphthalene; unsaturated mono-olefins; vinylidene halides; and sulfonic acids or sulfonates.

22. A process in accordance with claim 1 wherein said water soluble monomer is subsequently further polymerized by said heating.

23. A process in accordance with claim 1 wherein said water soluble monomer is fully polymerized during said suspension polymerization.

* * * * *